United States Patent [19]

Ohman

[11] 4,399,917

[45] Aug. 23, 1983

[54] DUAL CURTAIN ROD ASSEMBLY

[75] Inventor: Thor Ohman, Madison, Wis.

[73] Assignee: Graber Industries, Inc., Middleton, Wis.

[21] Appl. No.: 272,529

[22] Filed: Jun. 11, 1981

[51] Int. Cl.[3] ..... A47F 5/08

[52] U.S. Cl. ..... 211/87; 248/262; 160/39

[58] Field of Search ..... 211/87; 160/38, 39, 160/19; 248/262, 263

[56] References Cited

U.S. PATENT DOCUMENTS

| | | | |
|---|---|---|---|
| 1,798,584 | 3/1931 | Blakely | 211/87 |
| 2,066,824 | 1/1937 | Cohen | 248/262 X |
| 2,162,674 | 6/1939 | Kenny | 248/262 |
| 2,250,003 | 7/1941 | Boye | 160/39 X |
| 2,823,743 | 2/1958 | Isaac | 160/39 |
| 3,166,286 | 1/1965 | Pfaff | 160/39 X |

FOREIGN PATENT DOCUMENTS

| | | | |
|---|---|---|---|
| 260814 | 7/1912 | Fed. Rep. of Germany | 160/38 |

*Primary Examiner*—William E. Lyddane
*Assistant Examiner*—Peter A. Aschenbrenner
*Attorney, Agent, or Firm*—Vernon J. Pillote

[57] ABSTRACT

A curtain rod assembly for use in wide pocket curtains and the like to provide a wide header or band, which rod assembly includes vertically spaced upper and lower curtain rods, a plurality of spacer bars having rod engaging means at opposite ends for detachably engaging the upper and lower rods to rigidly interconnect the upper and lower rods intermediate their ends, and mounting brackets having vertically spaced upper and lower rod engaging supports for engaging the upper and lower rods adjacent their ends to support the ends of the rods in vertically spaced relation.

13 Claims, 4 Drawing Figures

Fig. 1.
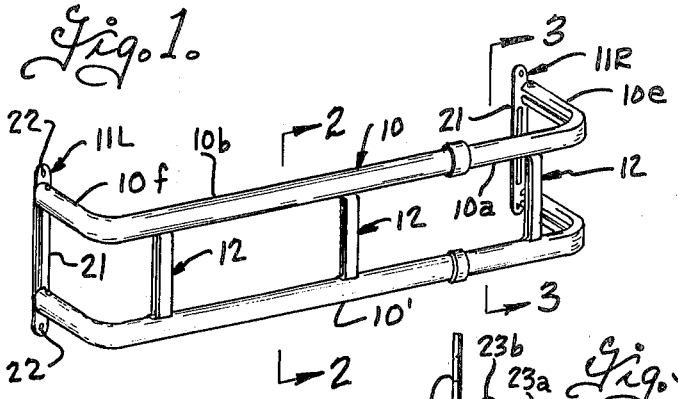
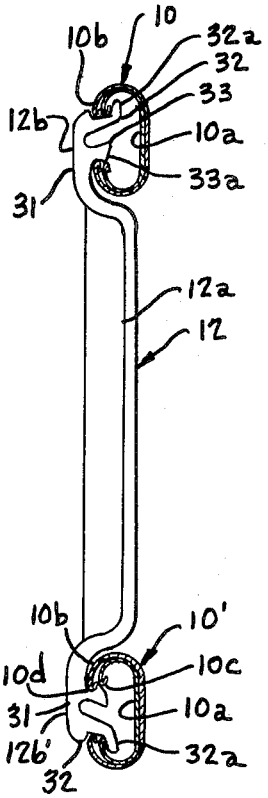
Fig. 2.
Fig. 3.
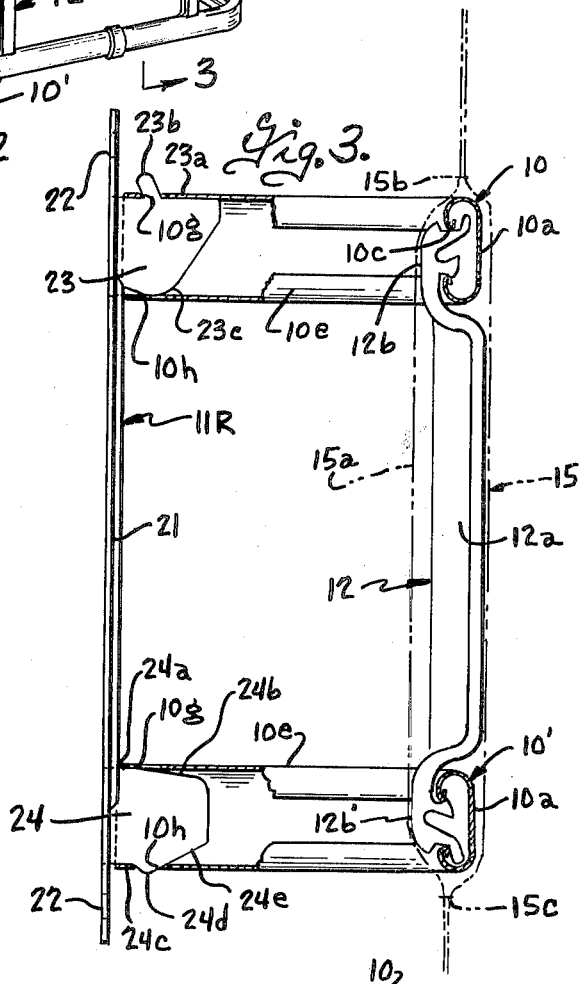
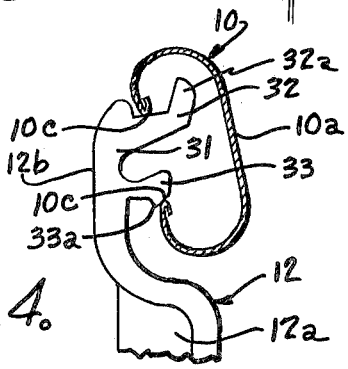
Fig. 4.

DUAL CURTAIN ROD ASSEMBLY

BACKGROUND OF THE INVENTION

Curtains, valances and the like are commonly made with a curtain rod receiving pocket along one end and mounted on a curtain rod that is inserted through the pocket, with the fabric gathered or shirred along the rod to provide folds or ruffles in the curtain or valance. Conventional curtain rods are relatively narrow with a face width of less than one inch. However, in order to produce different decorative effects, it has also been proposed to use a wide face curtain rod in curtains and the like having a wide rod receiving pocket to provide a relatively wide heading on the curtain or valance. Such wide face curtain rods require roll forms for forming the wide face rods that are different from those used in forming conventional narrow face curtain rods. In addition, increasing the face width of the curtain rod also increases its weight and the size of the containers required for packaging. Further, such wide face curtain rods are opaque and do not allow light transmission through the heading portion of the drapery or valance supported thereon.

It is an object of the present invention to overcome the disadvantages of the prior wide face curtain rods used to produce a wide heading on a curtain or valance, by providing a curtain rod assembly having vertically spaced upper and lower curtain rods that are interconnected intermediate their ends by spacer bars in such a manner as to allow insertion of the curtain rod assembly into a wide pocket in a curtain or valance.

Another object of this invention is to provide a curtain rod assembly for use in providing a wide heading on curtains, valances and the like, and which allows light transmission through the heading.

Still another object of this invention is to provide a curtain rod assembly for providing a wide heading on curtains, valances and the like and which is relatively light in weight and which can be disassembled for compact packaging, storage and transportation.

Yet another object of this invention is to provide a curtain rod assembly for wide pocket curtains and the like, and which can be made utilizing two conventional narrow curtain rods.

These, together with other objects and advantages of this invention will be more readily understood, by reference to the following detailed description when taken in connection with the accompanying drawings wherein:

FIG. 1 is a perspective view of a curtain rod assembly for wide pocket curtains and the like embodying the present invention;

FIG. 2 is a vertical sectional view taken on the plane 2—2 of FIG. 1 and illustrating parts on a larger scale;

FIG. 3 is a vertical sectional view taken on the plane 3—3 of FIG. 1 and illustrating the parts on the same scale as FIG. 2; and FIG. 4 is a fragmentary vertical sectional view illustrating interconnection of the rods and rod spacers.

The curtain rod assembly of the present invention is adapted for use in curtains, valances and the like formed with wide rod receiving pockets to provide a wide heading and may be used at the upper or lower or both ends of the curtain, if desired. The curtain rod assembly in general includes upper and lower curtain rods 10, 10', left and right mounting brackets 11L and 11R, engageable with the ends of the upper and lower curtain rods to support the same on an upright supporting surface, and vertical spacers 12 that extend between the vertically spaced rods and which have rod engaging means at opposite ends for engaging the upper and lower rods to vertically interconnect the spaced rods intermediate their ends. The mounting brackets may, for example, be mounted on a window frame or wall at opposite sides of the window opening so that the rod assembly extends across the window opening. Curtains, valances, and the like shown in dash lines in FIG. 3 and designated generally by the numeral 15, are commonly formed with a rod receiving pocket at one or both ends of the curtain, which pockets are usually formed by folding an end portion 15*a* of the curtain back upon itself as shown in phantom lines in FIG. 3, and stitching the overlapping portions together along spaced seam lines as indicated at 15*b* and 15*c*. In order to provide different decorative effects such as a wide heading, the curtains or valance can be formed with a relatively wide pocket as shown in FIG. 3. The upper and lower curtain rods 10, 10' are interconnected by the spacers 12 so that they are spaced apart a distance slightly less than the width of the pocket in the curtain or valance so that the rod assembly can be inserted into the pocket. The face width of the rod assembly can be varied over a wide range, dependent on the length selected for the rod spacers and mounting brackets, and may for example be in a range of three to six inches or more if desired. The mounting brackets 11L and 11R support the ends of the rods in vertically spaced relation on the upright supporting surface.

The rods 10, 10' are of like construction and like numerals are used to designate corresponding parts. The curtain rods are preferably formed so as to be longitudinally adjustable and each rod includes inner and outer telescopically related rod sections 10*a* and 10*b*. As shown in FIGS. 2–4, the rod sections 10*a* and 10*b* are formed with a generally C-shaped cross section, and the lengthwise extending edges 10*c* of the inner rod section are spaced apart a distance substantially equal to the spacing between the lengthwise extending edges 10*d* of the outer rod section to provide a lengthwise extending slot of generally uniform width at the rear side of the rod. The longitudinal edges of the rods may be folded back upon themselves or hemmed as shown in FIGS. 2–4, to avoid exposure of sharp edges. The inner and outer rod sections preferably have their end portions bent or curved to provide lateral end portions 10*e* and 10*f* on the inner and outer rod sections respectively, to space the curtain rods from the supporting surface.

The mounting brackets 11L and 11R are similarly constructed and like numerals are used to designate corresponding parts. Each of the mounting brackets 11L and 11R include an elongated mounting plate 21 having fastener receiving openings 22 adapted to receive fasteners to mount the brackets on an upright supporting surface. Upper and lower rod engaging members 23 and 24 are provided on each mounting bracket and arranged to engage and support the ends of the upper and lower rods 10, 10', respectively. The upper rod engaging member on each bracket is conveniently in the form of a generally flat blade dimensioned to extend into the respective end of the curtain rod and which has an upper surface 23*a* adapted to engage the upper inner side of the rod end to support the rod. A prong 23*b* extends upwardly from the upper surface 23*a* and is arranged to project through a top opening 10*g* in the end of the upper curtain rod 10, to hold the end of the upper curtain rod on the bracket. The curtain rod assembly is adapted to be installed on the brackets by hooking the top openings 10*g* in the end of the upper curtain rod on the prongs 23*b* and then swinging the rod assembly down to a position shown in FIG. 3. The lower edge 23*c* of the upper rod support 23 is rounded to engage the lower inner side of the rod end as the rod assembly is swung downwardly to the position shown in FIG. 3, and the spacing between the upper support surface 23*a* and the crest of the lower edge 23*c* is correlated with the interior dimensions of the respective end of the curtain rod so that the rod is firmly pressed against the upper support surface 23*a*, when the rod is in its position as shown in FIG. 3. The lower rod engaging member 24 is also conveniently in the form of a flat blade that is dimensioned to extend into the respective end of the lower curtain rod 10'. Since the upper and lower curtain rods are interconnected by the spacers 12 when they are installed on the mounting brackets, the lower curtain rod swings in an arc about the prong 23 as it moves into position on the lower rod support. The upper edge of the support 24 has a surface 24*a* that is spaced below the surface 23*a* on the upper rod support a distance corresponding to the desired spacing between the upper edges of the upper and lower rod members, and a cam surface 24*b* that is inclined downwardly from the surface 24*a* and arranged to cam the respective end of the rod onto the surface 24*a* as the rod is moved into position. The lower edge of the rod support 24 has a surface 24*c* spaced with surface 24*a* a distance corresponding to the internal dimension of the respective end of the lower curtain rod, to firmly clamp the rod end to the surface 24*a*. A protrusion 24*d* is provided on the lower rod support forwardly of the surface 24*c* and adapted to project through a bottom opening 10*h* in the rod section. A cam surface 24*e* extends forwardly and upwardly from the protrusion 24*d* to cam the lower inner side of the rod end over the protrusion 24*d*, as the lower rod member is swung into position on the mounting bracket. As previously discussed, the mounting brackets 11L and 11R are of similar construction. However, the rod supports 23 and 24 on the mounting bracket 11L extend into the end portions 10*f* of the outer rod sections 10*b* and the rod supports on the mounting bracket 11R extend into the end portions 10*e* of the inner rod sections 10*a*. The rod supports 23 and 24 on the right and left mounting brackets are conveniently of the same size and dimensioned to be snugly received in the end portions of the outer rod sections. The end portions of the inner rod sections are sufficiently resilient to expand when mounted on the rod supports. In addition, the rod supports 23 and 24 on the left rod section are preferably located at the left side of the mounting bracket while the rod supports on the right mounting bracket 11R are preferably located at the right side of the mounting plate so that the mounting plates are effectively concealed by the curtains or valance when installed.

The spacers 12 are arranged to rigidly interconnect the upper and lower rod members 10, 10' prior to installation on the mounting brackets so that the rod members and spacers can be inserted as a unit into the pocket in the curtain or valance. Plural spacers are preferably utilized to interconnect the upper and lower rod members and, advantageously, the rod engaging portions of the spacers are constructed and arranged so that they can be used on both the inner rod sections and the outer rod sections as well as at locations where the inner and outer rod sections are in telescopic relation. The spacers 12 include a relatively rigid spacer bar 12*a* dimensioned to extend between the upper and lower rod sections and upper and lower rod engaging means 12*b* and 12*b'* respectively are arranged to engage the upper and lower rods 10 and 10' to interconnect the same in vertically spaced relation intermediate their ends. As best shown in FIGS. 2 and 3, the front side of the spacer bar 12*a* is adjacent a plane through the front side of the upper and lower curtain rods and the rear side of the spacer bar is adjacent a plane through the rear sides of the upper and lower rods.

The upper and lower rod engaging means 12*b*, 12*b'* are conveniently of like construction and like numerals are used to designate corresponding parts. Each rod engaging means includes a body portion 31 adapted to overlie the slot at the rear of the respective rod and vertically spaced finger portions 32 and 33 extending forwardly from the body portion and adapted to project through the slot in the rod and engage the rod edges. The first finger portion 32 of each rod engaging means has a lateral protrusion 32*a* spaced forwardly from the associated body portion and the second finger portion also has a lateral protrusion 33*a* spaced forwardly from the associated body portion. In order to enable use of the same rod spacers at different locations along the rod, the protrusion 32*a* on the first finger 32 is spaced forwardly from the associated body portion 31 a distance sufficient to receive the overlapping edges of telescopically related inner and outer rod sections at one edge of the slot, as shown in FIG. 2. In order to properly position the rod adjacent the body portion, when the spacers are used on a single inner or outer rod section, the upper surface 32*b*, of the finger 32, in the region between the protrusion 32*a* and the body 31, is preferably inclined toward the body portion 31 at a shallow angle, for example about 10°, so as to tend to cam the rod rearwardly toward the body portion. The protrusion 33*a* on the other finger is spaced from the rear body portion a distance to receive the edge of a single rod section. The spacers 12 are made of a resilient material such as a resilient plastic material, and the upper and lower rod engaging means 12*b* and 12*b'* are each formed so that at least one of the finger portions is resiliently deformable relative to the other to allow the lateral protrusion 33*a* to snap over the edge of the rod sections. In the preferred embodiment illustrated, the second finger portion 33 is formed with a section sufficiently thin to allow the finger to flex relative to the finger portion 32 and enable the protrusion 33*a* to snap over the edge of the rod. Thus, the protrusion 33*a* is adapted to snap over the edge of the inner rod section, when the spacer is used on the inner rod section and over the edge of the outer rod section when the spacer is used on the outer rod section and to snap over the edge of the outer rod section when the spacer is used at a location along the rods where the inner and outer rod sections are in telescoping relation, as shown in FIG. 2. Preferably, the first finger portion 32 of each of the upper and lower rod engaging means are located adjacent the ends of the spacer 12 and the other finger portions 33 are located inwardly of the ends. With this arrangement, the spacer bar can be used with either end at the top.

From the foregoing it is thought that the construction and use of the curtain rod assembly will be readily understood. The curtain rod assembly is adapted for use in curtains, valances and the like having a wide rod receiving pocket to provide a wide header or the like, and the upper and lower curtain rods 10, 10' can conveniently be of the same form and construction used in conventional narrow face curtain rods. The spacers 12 interconnect the upper and lower curtain rods in vertically spaced relation to provide a wide rod assembly and the spacers can be used at all locations along the upper and lower rods, that is to connect the inner rod sections and to connect the outer rod sections and to also connect the rods where the inner and outer rod sections are in telescoping relation. The spacers rigidly interconnect the rods so that the rods and spacers can be inserted as a unit into the wide pocket in the curtain or valance. The rods are thereafter mounted by the rod mounting brackets 11L and 11R on the vertical mounting surface and the brackets support the ends of the rods in vertically spaced relation. With this arrangement, two conventional narrow curtain rods can be used in wide pocket curtains or valances to provide a wide header. The curtain rod assembly can be packaged unassembled for compact storage and shipment and can be easily assembled by the users to provide a wide rod assembly that allows light to pass through the header of the drapery or curtain mounted thereon.

The embodiments of the invention in which an exclusive property or privilege is claimed are defined as follows:

1. A curtain rod assembly for use in wide pocket curtains and the like comprising, upper and lower curtain rods each having a generally C-shaped cross section with spaced rod edges defining a slot at the rear side thereof, first and second mounting bracket means each including upper and lower rod engaging supports for detachably engaging the respective upper and lower curtain rods adjacent their ends to support the ends of the rods in vertically spaced relation, and at least one intermediate spacer bar dimensioned to extend between the upper and lower curtain rods and having upper and lower rod engaging means at opposite ends for engaging the upper and lower rods to interconnect the vertically spaced rods intermediate their ends, said upper and lower rod engaging means each including a rear body portion adapted to overlie the slot at the rear of the respective rod and first and second vertically spaced finger portions extending forwardly from the rear body portion and adapted to project through the slot in the rod and engage the rod edges along opposite sides of the slot, the first and second finger portions each having a lateral protrusion thereon spaced from the body portion for engagement with the rod internally thereof, said upper and lower rod engaging means each being constructed and arranged so that at least one of said first and second fingers is resiliently deformable relative to the other to allow the lateral protrusion thereon to snap over the edge of the rod.

2. A curtain rod assembly according to claim 1 wherein said spacer bar has its forward face generally coplanar with the front side of the upper and lower curtain rods.

3. A curtain rod assembly according to claim 1 wherein said upper and lower curtain rods each include inner and outer telescoping rod sections having their edges spaced apart substantially the same distance.

4. A curtain rod assembly according to claim 3 wherein said inner and outer rod sections each have a laterally extending end portion.

5. A curtain rod assembly for use in wide pocket curtains and the like comprising, upper and lower curtain rods each having a generally C-shaped cross-section with spaced rod edges defining a slot at the rear side thereof, first and second mounting bracket means each including upper and lower rod engaging supports for detachably engaging the respective upper and lower curtain rods adjacent their ends to support the ends of the rods in vertically spaced relation, and at least one intermediate spacer bar dimensioned to extend between the upper and lower curtain rods and having upper and lower rod engaging means at opposite ends for engaging the upper and lower rods to interconnect the vertical spacer rods intermediate their ends, said upper and lower curtain rods each including inner and outer telescoping rod sections each having their edges spaced apart substantially the same distance and said rod assembly includes at least two of said spacer bars of the same configuration, said upper and lower rod engaging means each including a body portion adapted to overlie the slot at the rear of the respective rod and first and second vertically spaced finger portions extending forwardly from the body portion and adapted to project through the slot in the rod and engage the spaced rod edges, said first finger portions of each rod engaging means having a lateral protrusion thereon spaced forwardly from the associated body portion a distance sufficient to receive the overlapping edges of telescopically related inner and outer rod sections at one edge of the slot, said second finger portion having a lateral protrusion spaced forwardly from the associated body portion a distance to receive the edge of one rod section therebetween.

6. A curtain rod assembly according to claim 5 wherein said upper and lower rod engaging means are each constructed and arranged so that at least one of said first and second finger portions is resiliently deformable relative to the other to allow the lateral protrusion thereon to snap over the edge of the rod.

7. A curtain rod assembly according to claim 5 wherein said first of said finger portions has a rod edge engaging surface that is inclined toward the rear body portion to cam the rod toward the rear body portion.

8. A curtain rod assembly according to claim 5 wherein said first finger portions of the upper and lower rod engaging means are located at the ends of the spacer bar and the second finger portions of the upper and lower rod engaging means are located inwardly of the ends of the spacer bar.

9. A curtain rod assembly according to claim 6 wherein said first of said finger portions has a rod edge engaging surface that is inclined toward the rear body portion to cam the rod toward the rear body portion.

10. A curtain rod assembly according to claim 6 wherein said first finger portions of the upper and lower rod engaging means are located at the ends of the spacer bar and the second finger portions of the upper and lower rod engaging means are located inwardly of the ends of the spacer bar.

11. A curtain rod assembly for use in wide pocket curtains and the like comprising, upper and lower curtain rods each having a generally C-shaped cross section with spaced rod edges defining a slot at the rear side thereof, first and second mounting bracket means each including upper and lower rod engaging supports for detachably engaging the respective upper and lower curtain rods adjacent their ends to support the ends of the rods in vertically spaced relation, and at least one intermediate spacer bar dimensioned to extend between the upper and lower curtain rods and having upper and lower rod engaging means at opposite ends for engaging the upper and lower rods to interconnect the vertically spaced rods intermediate their ends, the upper and lower rod engaging means each including a rear body portion formed integrally with the spacer bar adapted to overlie the rear of the respective rod and first and second vertically spaced wall portions integral with the rear body portion and extending forwardly from the rear body portion and adapted to project through the slot in the rod and engage the rod edges along opposite sides of the slot, the first and second wall portions each having a lateral protrusion integral therewith spaced forwardly from the rear body portion for engagement with the rod internally thereof, the protrusion on one wall portion being adapted to snap over the rod edge at one side of the slot when the other wall portion engages the rod edge at the other side of the slot to enable assembly of the spacer bar laterally onto the rods when the spacer bar is at a location intermediate the ends of the rod.

12. A curtain rod assembly according to claim 11 wherein one of said wall portions is inclined toward the rear body portion to cam the rod toward the rear body portion.

13. A curtain rod assembly according to claim 11 wherein the first wall portions of the upper and lower rod engaging means are located at the ends of the spacer bar and the second wall portions of the upper and lower rod engaging means are located inwardly of the ends of the spacer bar, the first wall portions being inclined toward the rear body portion to cam the rod toward the rear body portion.

* * * * *